US010961747B1

(12) United States Patent
Myers et al.

(10) Patent No.: US 10,961,747 B1
(45) Date of Patent: Mar. 30, 2021

(54) DEVICE FOR SECURING A DOOR

(71) Applicant: The Government of the United States as represented by the Director, National Security Agency, Ft. George G. Meade, MD (US)

(72) Inventors: David A. Myers, Kingsville, MD (US); Adam S. Wytko, Columbia, MD (US)

(73) Assignee: U.S. Government as represented by the Director, National Security Agency, Washington, DC (US)

( * ) Notice: Subject to any disclaimer, the term of this patent is extended or adjusted under 35 U.S.C. 154(b) by 286 days.

(21) Appl. No.: 16/232,468

(22) Filed: Dec. 26, 2018

(51) Int. Cl.
*E05B 65/00* (2006.01)
*E05B 67/38* (2006.01)
*E05C 19/00* (2006.01)

(52) U.S. Cl.
CPC ..... *E05B 65/0075* (2013.01); *E05B 67/383* (2013.01); *E05C 19/003* (2013.01)

(58) Field of Classification Search
CPC .... E05B 65/0075; E05B 67/383; E05B 65/06; E05B 65/02; E05B 65/025; E05B 65/46; E05B 65/48; E05C 19/003
USPC ..... 70/2, 6, 14, 85–88, 91, 101, 102; 49/394; 292/256, 258, 281, 283, 285, 292/288–298
See application file for complete search history.

(56) References Cited

U.S. PATENT DOCUMENTS 810,692 A * 1/1906 Anderson et al.
1,390,009 A 9/1921 Arledge
1,579,298 A * 4/1926 Fry ..... E05C 19/182 292/298
1,977,430 A * 10/1934 Dalton ..... E05C 19/182 292/296
2,226,640 A * 12/1940 Smythe ..... E05C 19/182 292/295
2,720,102 A 10/1955 Spain
2,969,253 A * 1/1961 Schettl ..... E05C 19/182 292/294

(Continued)

FOREIGN PATENT DOCUMENTS

WO 2014/152711 A2 9/2014

OTHER PUBLICATIONS

Manual for Installation Instructions Milockie; retrieved from http://www.milockie.com/manual_1.html on Dec. 20, 2018.

(Continued)

*Primary Examiner* — Lloyd A Gall

(57) ABSTRACT

A device for securing a door includes an elongated flat rigid member. A first segment is connected to a second segment by a transition segment perpendicular to the first and second segments. The first segment forms an aperture to admit a restraining device. The device also includes a first blocking member having two apertures and configured to engage the first member such that the restraining device restrains the first blocking member relative to the flat rigid member. The device also includes a second blocking member configured to lockably engage the second segment, thereby securing the device relative to a frame of the door with the first and second segments on opposite sides of the frame. When the device is secured and the door closed, and the first blocking member restrained relative to the flat rigid member, the door is blocked from being opened by the first and second blocking members.

3 Claims, 11 Drawing Sheets

(56) References Cited

U.S. PATENT DOCUMENTS 3,181,319 A * 5/1965 Hudon ..... E05C 19/182 70/14
3,352,587 A * 11/1967 Harvey ..... E05C 19/182 292/289
3,563,593 A * 2/1971 Leier ..... E05C 19/182 292/296
3,834,746 A * 9/1974 Hinden ..... E05C 19/182 292/290
4,003,227 A * 1/1977 Casey ..... E05B 13/002 70/14
4,326,394 A * 4/1982 Stein ..... E05C 19/182 292/292
4,399,672 A * 8/1983 Moorhouse ..... E05C 19/18 292/289
4,405,165 A * 9/1983 Johns ..... E05C 19/182 292/258
5,291,760 A * 3/1994 Schrader ..... E05C 19/18 292/288
5,325,685 A 7/1994 Frank
5,400,622 A * 3/1995 Harmon ..... G11B 33/005 70/14
5,401,068 A * 3/1995 Barnard ..... E05C 19/18 292/289
5,664,814 A * 9/1997 Lin ..... E05C 19/182 292/288
5,819,561 A * 10/1998 Blehi, III ..... E05B 67/36 70/14
6,755,450 B1 * 6/2004 Chen ..... E05C 19/182 292/289
8,510,994 B2 * 8/2013 Scott ..... E05B 17/2084 49/394
2011/0072865 A1 * 3/2011 Kaminsky, Jr. ..... E06B 7/16 70/102
2016/0002957 A1 * 1/2016 Trinh ..... E05B 63/0052 70/78
2017/0037662 A1 * 2/2017 Braun ..... E05B 67/36

OTHER PUBLICATIONS

Bloxsafe Executive Model Instructions and Information; Bloxsafe Limited; London.

* cited by examiner

DEVICE FOR SECURING A DOOR

FIELD OF INVENTION

The present invention relates, in general, to locking devices and, in particular, to devices for use in connection with securing doors against unauthorized opening.

BACKGROUND OF THE INVENTION

Often it may be desirable to use supplemental security measures to keep a door shut. For example, travelers often wish to store valuables in safes provided in their hotel rooms, but these safes are known to be accessible to hotel staff via a universal key or combination, and the traveler may wish also to prevent hotel staff from opening the safe without the traveler's knowledge and permission. Some approaches to providing supplemental security in such a case have suffered various drawbacks. For example, some approaches have utilized nylon straps that may be cut by a person who wishes to defeat the security measure. Other approaches have included clamps to be applied to the walls of a safe. Such an approach may be awkward and require the use of large and heavy equipment relative to what a traveler would prefer to carry, and the clamps may be susceptible to being dislodged.

SUMMARY

One embodiment of the present invention is a device for securing a door against opening from a first side of the door. The device includes an elongated flat rigid member having a first segment and a second segment. The first segment is rigidly connected to the second segment by a transition segment of the member. The transition segment is perpendicular to both the first segment and the second segment. The first segment forms at least one aperture adapted to allow a supplemental restraining device to pass through the aperture in the first segment of the member. The device also includes a first blocking member having at least two apertures and configured to engage the first member such that on each side of the aperture of the flat rigid member one of the apertures of the first blocking member is aligned such that the supplemental restraining device can pass through each of the apertures, thereby restraining the first blocking member from moving relative to the flat rigid member. The device also includes a second blocking member configured to lockably engage the second segment of the flat rigid member, thereby securing the device in place relative to a frame of the door such that the first segment is disposed on a first side of the frame of the door and the second segment and the transition segment are disposed on a second side of the frame of the door. When the device is secured in place relative to the frame of the door and the door is closed, and the first blocking member is restrained from moving relative to the flat rigid member by the supplemental restraining device, the door is blocked from being opened from the first side of the door by the first blocking member and the second blocking member.

DETAILED DESCRIPTION

Figure 1:
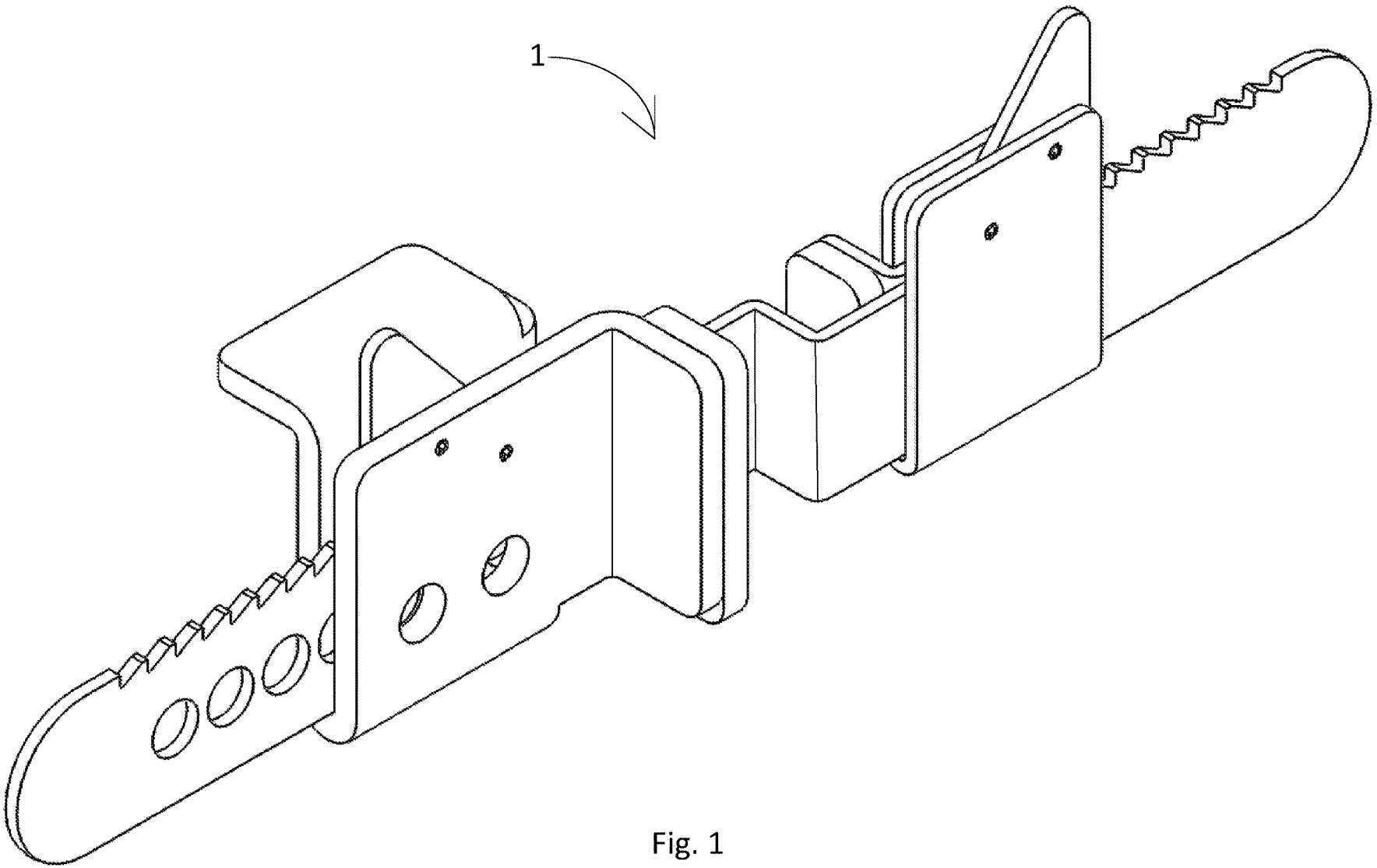
FIG. 1 is a perspective view of a device in accordance with an embodiment of the present invention.
Figure 2:
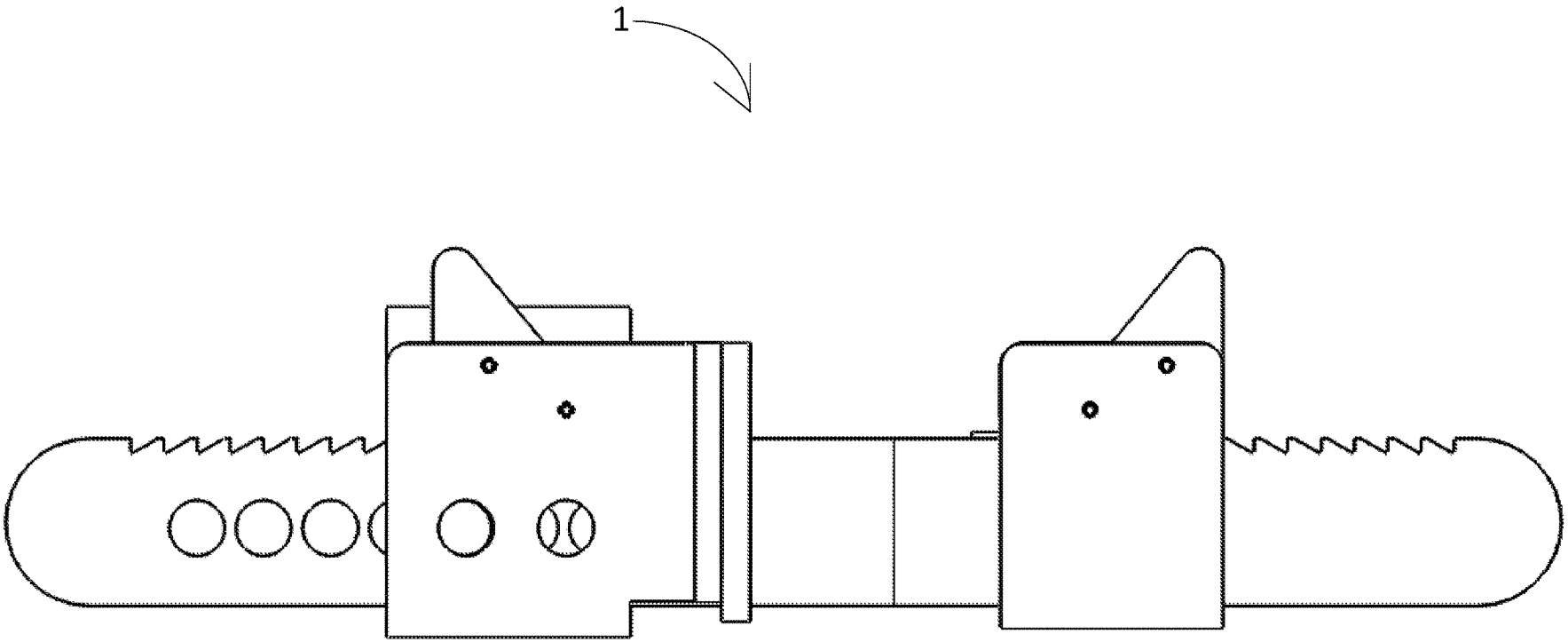
FIG. 2 is a side view of the device of FIG. 1.
Figure 3:
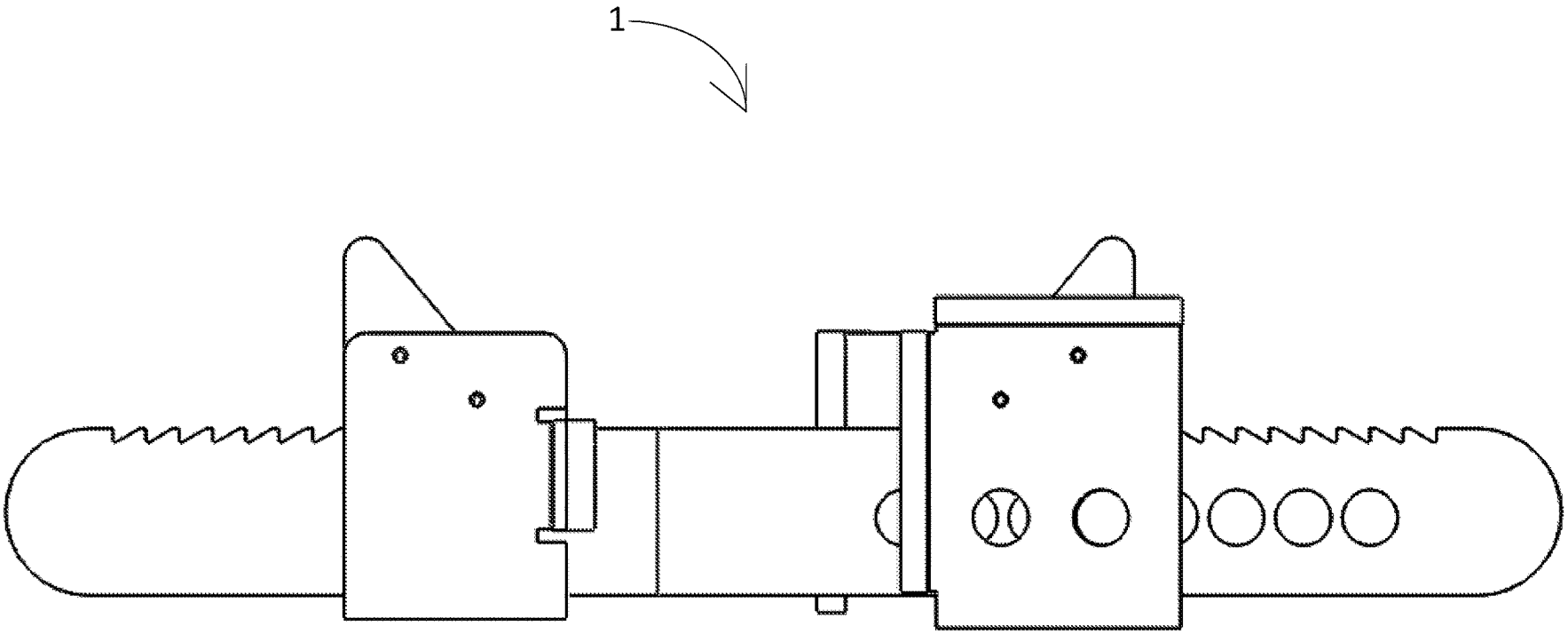
FIG. 3 is a side view of the device of FIG. 1.
Figure 4:
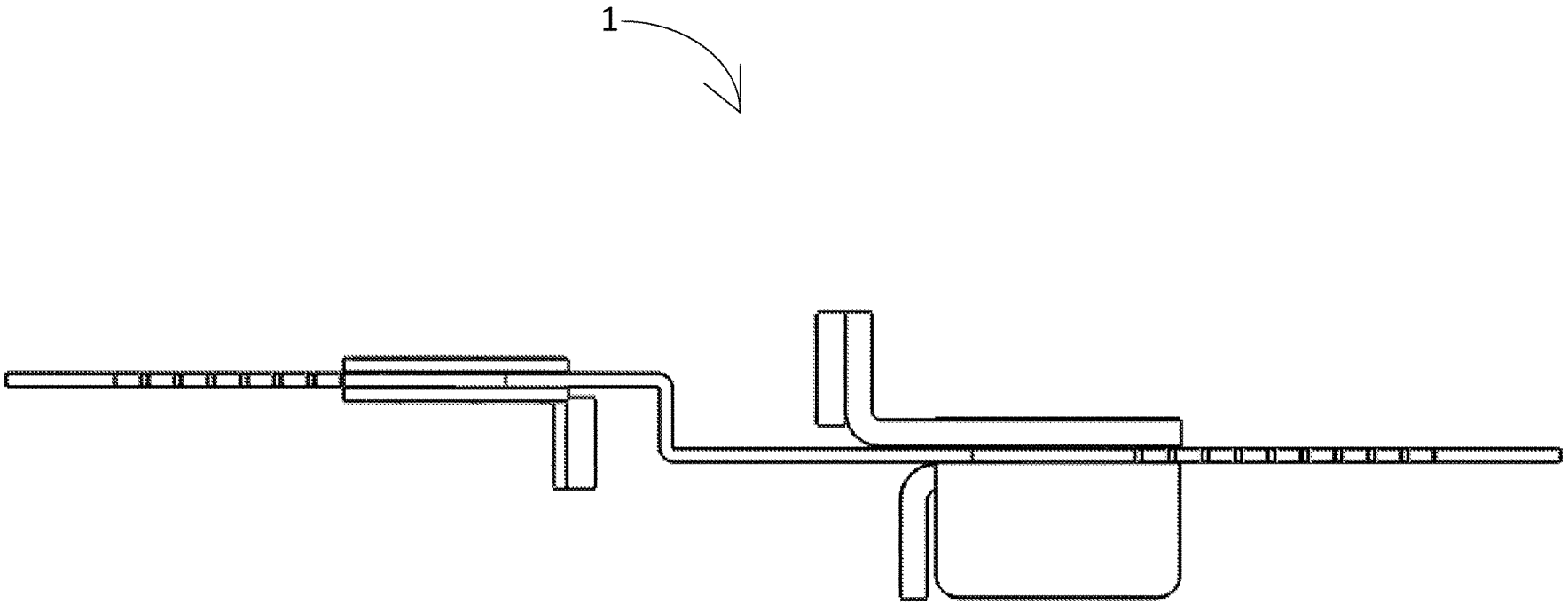
FIG. 4 is a top view of the device of FIG. 1.

A device in accordance with embodiments of the present invention is now described with reference to FIGS. 1-5. FIG. 1 is a perspective view of a device 1 in accordance with an embodiment of the present invention. FIG. 2 is a side view of the device 1 of FIG. 1. The side visible in FIG. 1 is the same side that is visible in FIG. 2. FIG. 3 is a side view of the device 1 of FIG. 1 showing the other side that is not visible in FIG. 2. FIG. 4 is a top view of the device 1 of FIG. 1.

Figure 5:
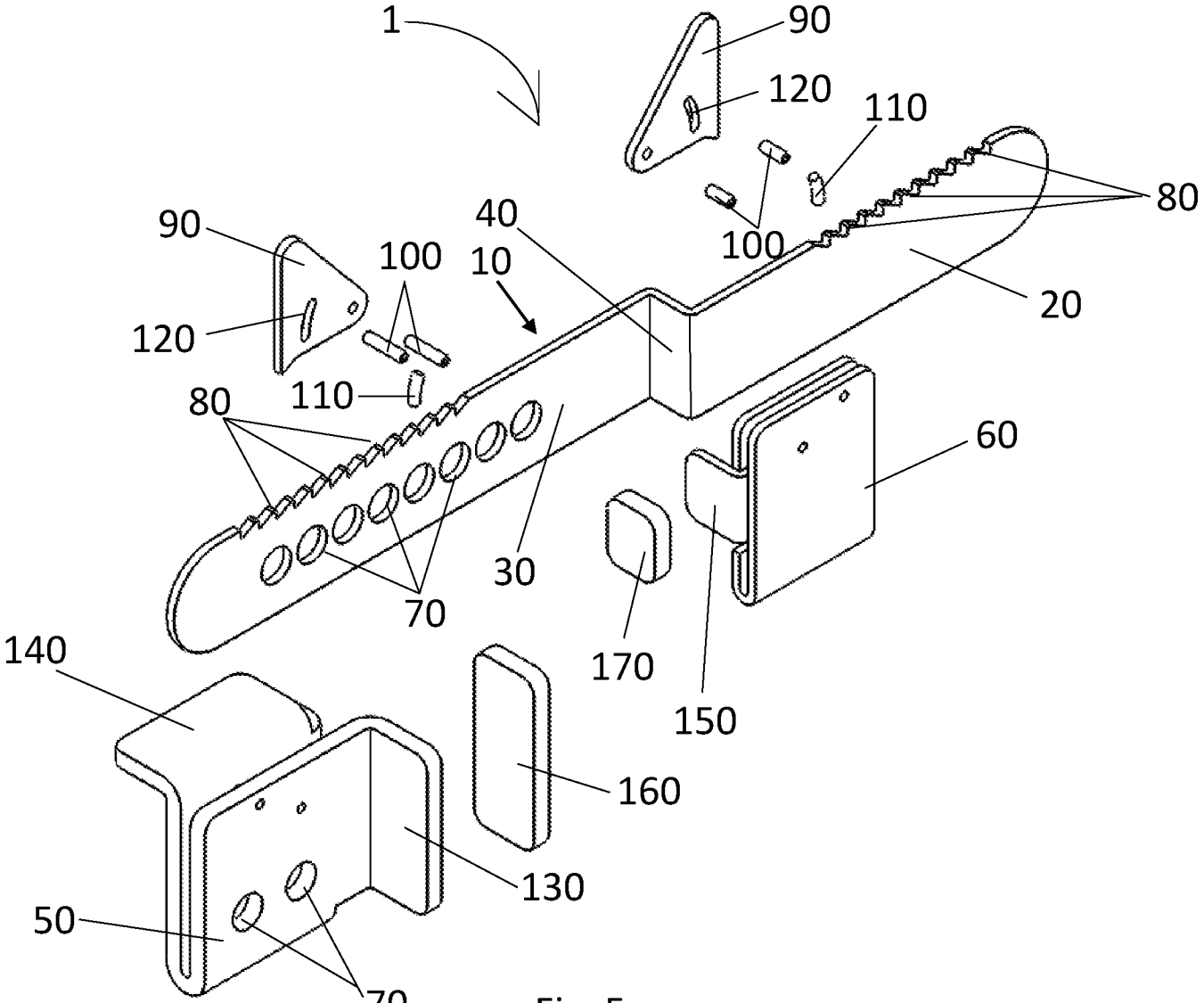
FIG. 5 is an exploded perspective view of the device of FIG. 1.

FIG. 5 is an exploded perspective view of the device 1 of FIG. 1. An elongated flat rigid member 10 has a first segment 30 and a second segment 20 connected by a transition segment 40. The transition segment 40 is perpendicular to both the first segment 30 and the second segment 20. The rigid member 10 may be manufactured from any material that is sufficiently rigid and sturdy to resist bending and breaking under strain, such as when someone attempts to force open a door that is being held shut by the device 1. In some embodiments, a hard metal may be used, such as stainless steel. The particular shape of the elongated member 10 is adapted for use in a door frame having a lip perpendicular to the wall of the door frame, as will be discussed further below, with reference to FIGS. 6 and 7.

The body of the first segment 30 also forms a series of apertures 70. The apertures 70 are adapted for use with a supplemental restraining device that passes through one of the apertures 70. For example, a padlock, wire tie, or the like may be used to secure the device 1, as will be discussed further below, with reference to FIGS. 10 and 11.

The first segment 30 and the second segment 20 also both form teeth 80 configured to function as part of a pair of ratcheting mechanisms. The first segment 30 is situated in a first blocking member 50, which is coupled to the first segment 30 by a tooth 90. The tooth 90, in turn, is coupled to the first blocking member 50 by a pair of pins 100. A spring 110, positioned in a slot 120, provides tension to hold the tooth 90 in place at a particular location along the teeth 80 of the first segment 30. Manual pressure may be applied against the tooth 90 to compress the spring 110, rotating the tooth 90 around one of the pins 100 while the other pin 100 compresses the spring 110 as it slides within the slot 120 in the tooth 90 which defines a range of motion for the tooth 90. This allows the tooth 90 to disengage the teeth 80 such that the blocking member 50 may be repositioned as desired relative to the first segment 30 by sliding lengthwise along the segment 30. When the tooth 90 is released, it reengages the teeth 80 to fix the blocking member 50 in its new location.

The blocking member 50 also forms apertures 70. Based on the position of the member 50 relative to the first segment 30, one of the apertures 70 of the blocking member 50 will be aligned with one of the apertures 70 of the segment 30. This allows for the blocking member 50 to be secured at a desired location by use of a supplemental restraint, such as by attaching a padlock through the apertures 70. A first flange 130 is formed perpendicular to the main body of the blocking member 50 and is adapted to rest flat against a surface of a door that is being secured by the device 1. A pad 160 is attached to the surface of the flange 130 to avoid scratching the surface of the door and to provide grip. A second flange 140, also perpendicular to the main body of the blocking member 50, but having a surface also perpendicular to the first flange 130, provides additional stability and protection. When the blocking member is securely pressed against the door, the second flange 140 provides additional protection against the device being bent forcefully sideways in an attempt to bend or break the member 10 so as to defeat the device 1.

The device also includes a second blocking member 60. The second segment 20 is situated within the second blocking member 60. The second blocking member 60 is coupled to the second segment 20 by a tooth 90. The tooth 90, in turn, is coupled to the second blocking member 60 by a pair of pins 100. A spring 110 provides tension to hold the tooth 90 in place at a particular location along the teeth 80 of the second segment 20. Manual pressure may be applied against the tooth 90 to compress the spring 110, rotating the tooth 90 around one of the pins 100 while the other pin 100 slides within a slot 120 in the tooth 90 which defines a range of motion for the tooth 90. This allows the tooth 90 to disengage the teeth 80 such that the blocking member 60 may be repositioned as desired relative to the second segment 20 by sliding lengthwise along the segment 20. When the tooth 90 is released, it reengages the teeth 80 to fix the blocking member 60 in its new location.

A flange 150 is formed perpendicular to the main body of the blocking member 60 and is adapted to rest flat against a lip of a door frame of a door that is being secured by the device 1. A pad 170 is attached to the surface of the flange 150 to avoid scratching the surface of the lip and to provide grip. The device 1 may be held securely in place by the tension between the transition segment 40 of the member 10 and the flange 150 of the second blocking member 60, which will be pressed against opposite sides of the lip of the door frame. Unlike the first blocking member 50, in the presently described embodiment the second blocking member 60 is not configured to be secured against efforts to move it by hand, because the second blocking member 60 will be located in a space inaccessible to would-be tamperers, for example, on the interior of a safe or the interior of a desk drawer.

Figure 6:
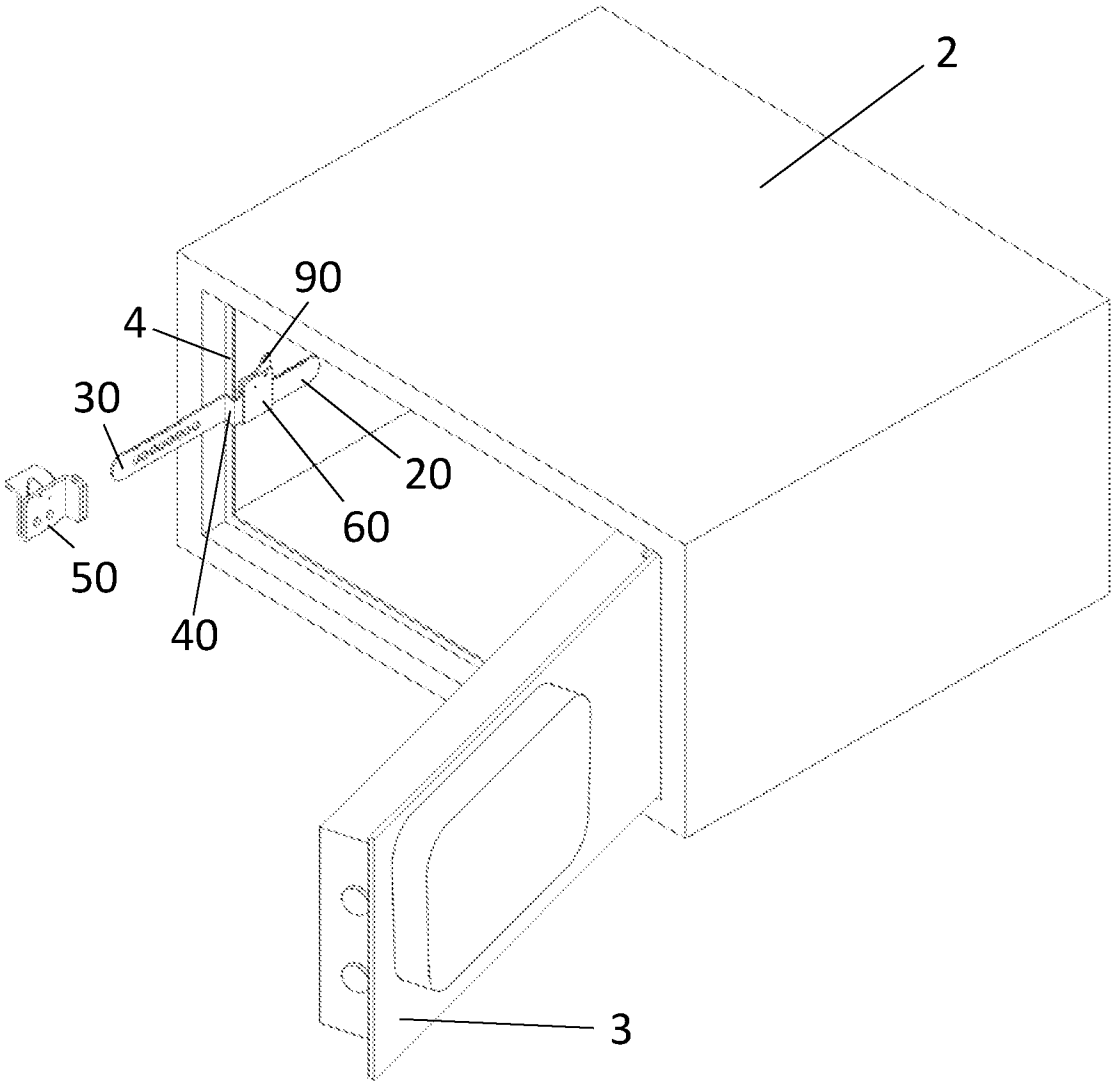
FIG. 6 is an illustration of an exemplary use of the device of FIG. 1.
Figure 7:
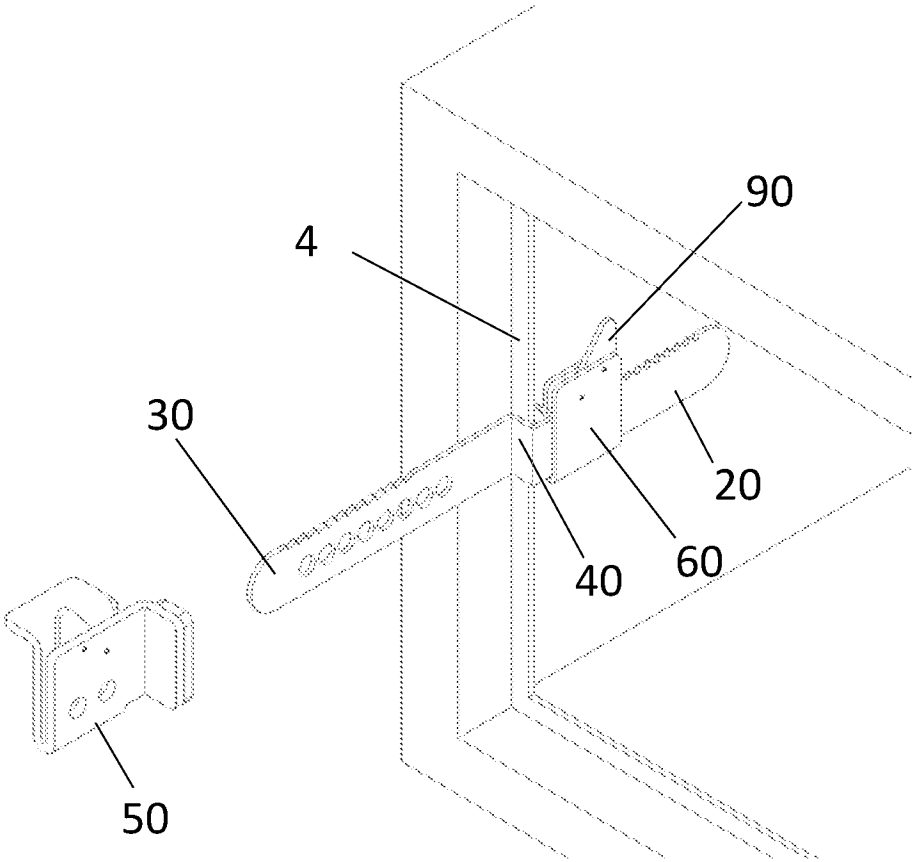
FIG. 7 is a close-up view of the illustration of FIG. 6.

Operation of an embodiment of the present invention is now discussed with reference to FIGS. 6-11. FIG. 6 is an illustration of an exemplary use of the device of FIG. 1, and FIG. 7 is a close-up view of the illustration of FIG. 6. In this embodiment, the device is used to secure a door 3 of a safe 2, which may be, e.g., a hotel safe, such as are commonly provided in hotel rooms for use by guests of the hotel. The second segment 20 is positioned in the interior space of the safe 2, with the first segment 30 extending into the exterior. The safe 2 includes a lip 4 into which the door 3 is configured to close. The device is positioned such that the transition segment 40 is flush against the lip 4 on the side facing the exterior of the safe 2, and the tooth 90 may be operated to position the blocking member 60 firmly against the interior side of the lip 4. Tension between the transition segment 40 and the blocking member 60 may then hold the elongated member securely in place, against the lip, although the connection does not need to be tight in all embodiments and all uses. In cases where the connection is tight, a user of the device may more easily use both hands to operate the door 3 and the blocking member 50, as the remainder of the device is holding itself in place. The device also may be allowed to sit at the bottom of the lip 4 in cases where the height at which the device is positioned is not restrained by other factors.

Figure 8:
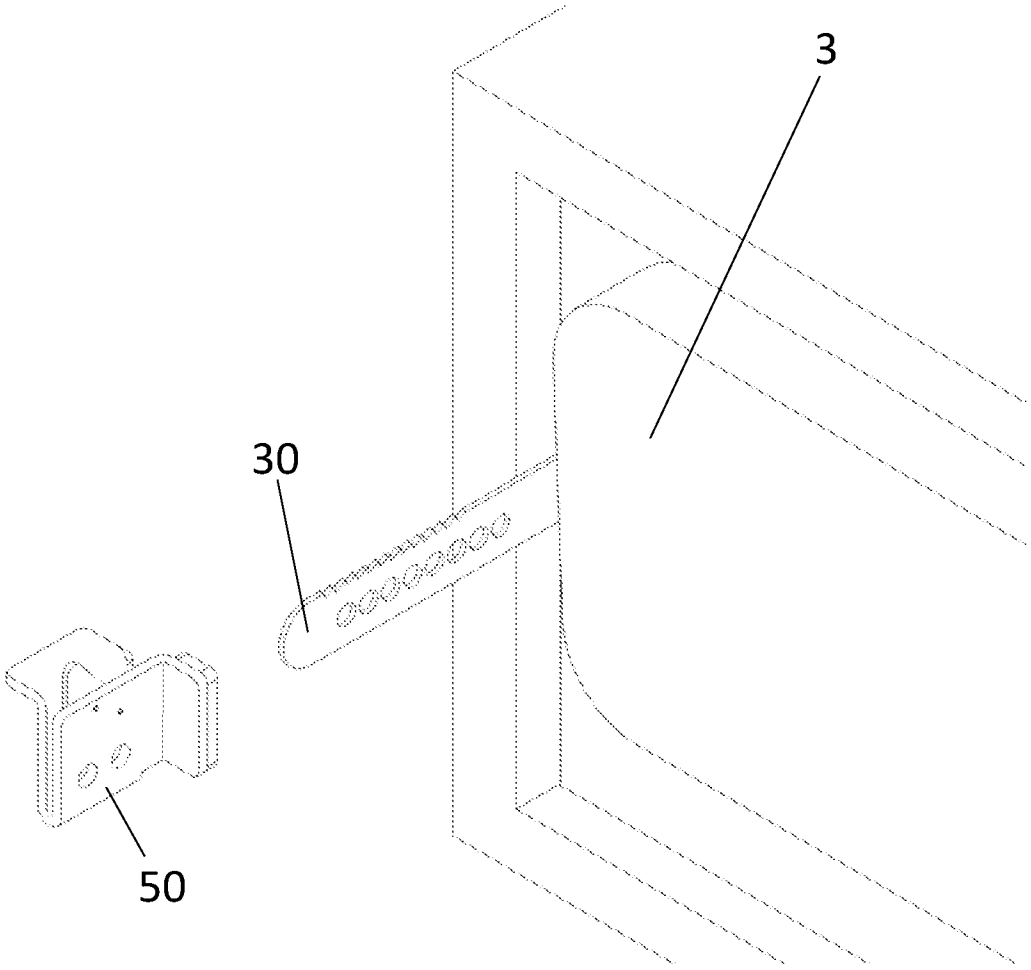
FIGS. 8-10 are illustrations of an exemplary use of the device of FIG. 1.
Figure 9:
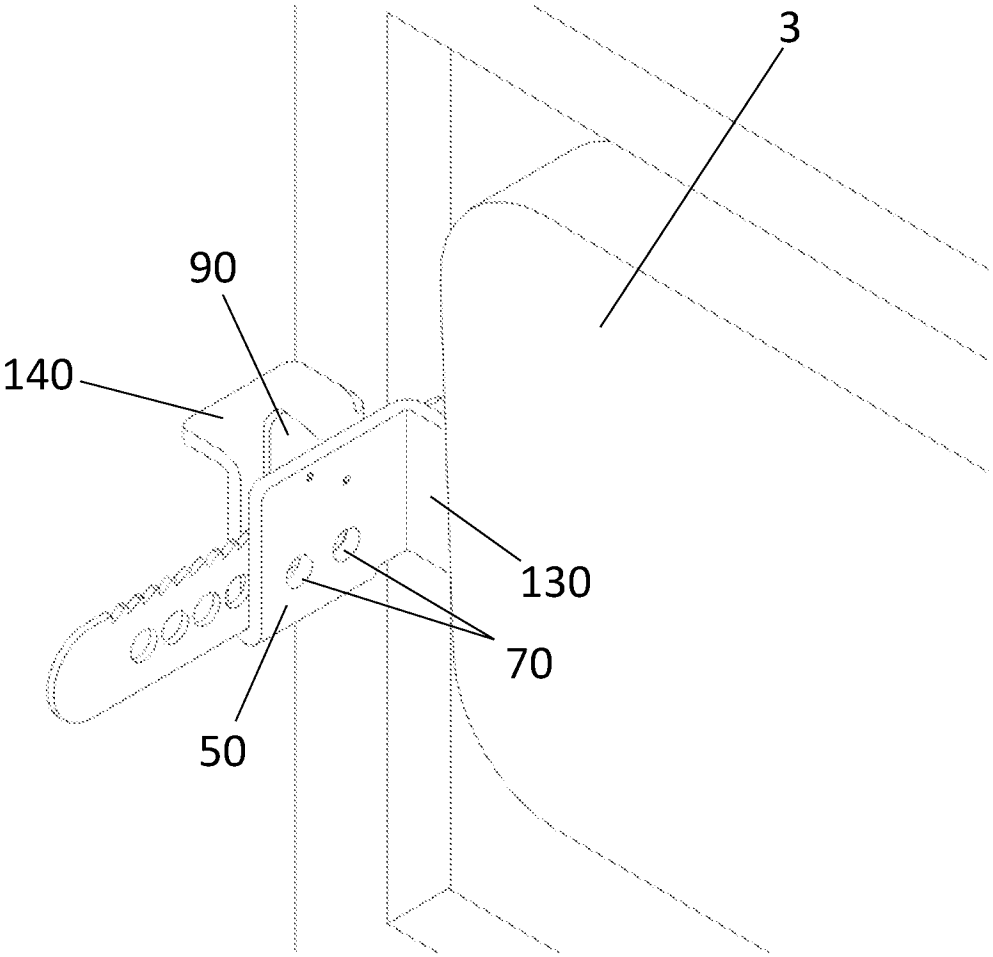
Figure 10:
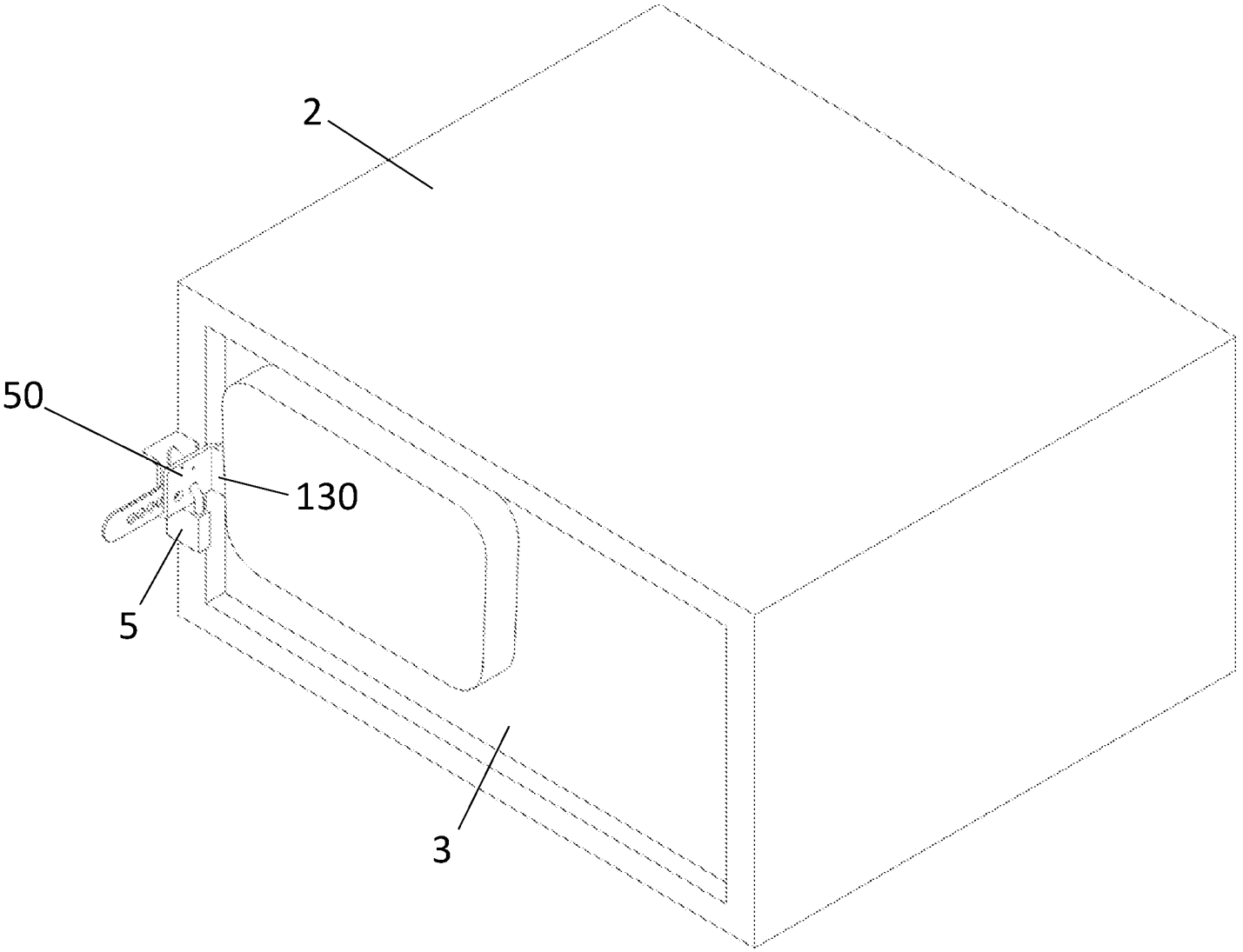
Figure 11:
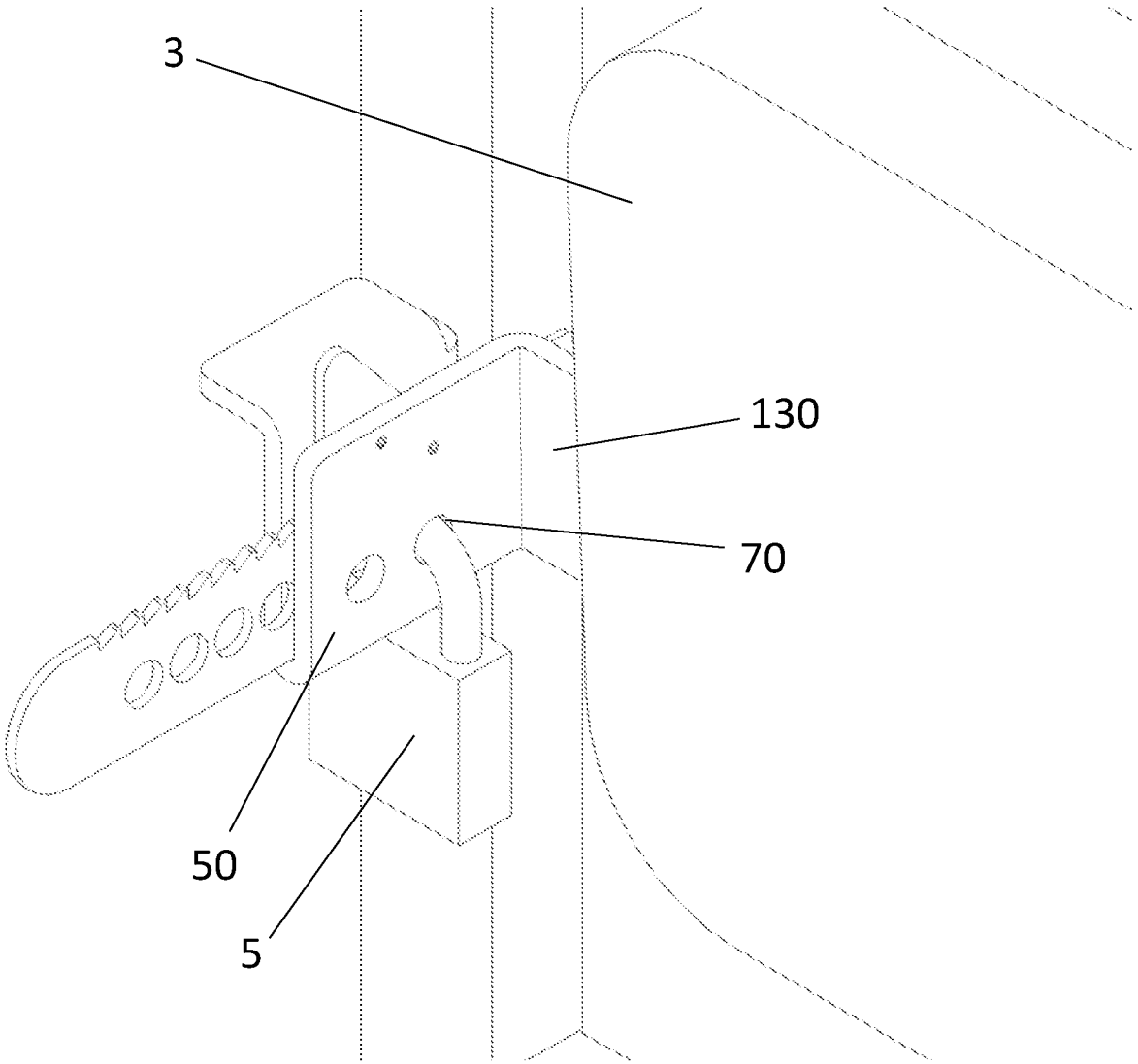
FIG. 11 is a close-up view of the illustration of FIG. 10.

Once the device has been attached to the safe 2 as just described, the door 3 may be shut, resulting in the configuration shown in FIG. 8. The safe 2 is in a closed state and may be locked in accordance with its conventional usage, but the first segment 30 is protruding through a small gap next to the door 3. The blocking member 50 may now be attached as shown in FIG. 9 by sliding the blocking member 50 along the first segment 30 until it abuts the surface of the door 3. When secured in this position, the flange 130 prevents the door 3 from being opened without first removing the blocking member 50, while the flange 140 stabilizes the blocking member 50 and thus resists attempts to bend or break the first segment. According to the presently illustrated embodiment, the blocking member 50 can slide freely in this direction, but is restrained from sliding away from the door 3 due to the ratchet mechanism. The tooth 90 may be used to release the ratcheting mechanism if it is desired to slide the blocking member 50 in the opposite direction, e.g., to remove it. According to the presently illustrated embodiment, at every set point of the ratcheting mechanism, one of the two apertures 70 of the blocking member will be aligned with an aperture of the first segment. This allows the device to be secured with an external restraint, such as a padlock 5, as shown in FIGS. 10 and 11.

While the above description has shown, described, and pointed out novel features as applied to various embodiments, it will be understood that various omissions, substitutions, and changes in the form and details of the devices illustrated can be made without departing from the spirit of the disclosure. As will be recognized, certain embodiments described herein can be embodied within a form that may not provide all of the features and benefits set forth herein, as some features can be used or practiced separately from others. The scope of the invention is indicated by the appended claims rather than the foregoing description. All changes which come within the meaning and range of equivalency of the claims are to be embraced within their scope.

We claim:

1. A device for securing a door against opening from a first side of the door, the device comprising:

an elongated flat rigid member comprising a first segment and a second segment, wherein the first segment is rigidly connected to the second segment by a transition segment of the member, the transition segment being perpendicular to both the first segment and the second segment, wherein the first segment forms at least one aperture adapted to allow a supplemental restraining device to pass through the at least one aperture in the first segment of the member;

a first blocking member having at least two apertures and configured to engage the first segment such that on each side of the at least one aperture of the flat rigid member one of the apertures of the first blocking member is aligned such that the supplemental restraining device can pass through each of the apertures, thereby restraining the first blocking member from moving relative to the flat rigid member; and a second blocking member configured to lockably engage the second segment of the flat rigid member, thereby securing the device in place relative to a frame of the door such that the first segment is disposed on a first side of the frame of the door and the second segment and the transition segment are disposed on a second side of the frame of the door;

wherein when the device is secured in place relative to the frame of the door and the door is closed, and the first blocking member is restrained from moving relative to the flat rigid member by the supplemental restraining device, the door is blocked from being opened from the first side of the door by the first blocking member and the second blocking member.

2. A device in accordance with claim 1, wherein the second blocking member lockably engages the second segment of the flat rigid member using a ratcheted lever.

3. A device in accordance with claim 1, wherein the first blocking member lockably engages the first segment of the flat rigid member using a ratcheted lever.

* * * * *